US005230684A

United States Patent [19]

Wallisch

[11] Patent Number: 5,230,684

[45] Date of Patent: Jul. 27, 1993

[54] TRICEPS PYRAMID EXERCISER

[75] Inventor: Michael D. Wallisch, Coudersport, Pa.

[73] Assignee: Hannibal Fitness Products, Inc., Dallas, Tex.

[21] Appl. No.: 885,625

[22] Filed: May 18, 1992

[51] Int. Cl.[5] ..... A63B 26/00

[52] U.S. Cl. ..... 482/141; 482/91; 482/148

[58] Field of Search ..... 482/146, 141, 114, 129, 482/139, 148, 49, 91, 309.1; 15/235.4, 235.6, 235.7, 236.02; 273/22; D21/191, 198

[56] References Cited

U.S. PATENT DOCUMENTS

| | | | |
|---|---|---|---|
| 216,529 | 2/1870 | Bock . | |
| 267,420 | 12/1882 | Malachowky . | |
| 269,691 | 7/1883 | Ornsteine t al. . | |
| 315,003 | 2/1891 | Huang . | |
| 2,198,974 | 4/1940 | Pilant | 15/235.4 |
| 2,666,640 | 1/1954 | Jennings, Sr. . | |
| 2,817,347 | 12/1954 | Hilt, Sr. . | |
| 3,070,823 | 1/1963 | Heinig | 15/236.02 |
| 3,101,944 | 3/1961 | Cencig | 482/114 |
| 3,115,338 | 12/1963 | Acs et al. . | |
| 3,540,724 | 11/1970 | Hunter . | |
| 3,750,229 | 8/1973 | Rossomme | 15/304.1 |
| 3,863,919 | 2/1975 | Sardelli | 273/22 |
| 4,232,863 | 11/1980 | Roach . | |
| 4,327,907 | 5/1982 | DeVries . | |
| 4,351,525 | 9/1982 | Rozenblad . | |
| 4,358,106 | 11/1982 | Shadford . | |
| 4,854,573 | 8/1989 | Johannson et al. . | |
| 4,970,749 | 11/1990 | Priore | 15/236.02 |

*Primary Examiner*—Richard J. Apley
*Assistant Examiner*—Jerome Donnelly
*Attorney, Agent, or Firm*—Webb, Burden, Ziesenheim & Webb

[57] ABSTRACT

A portable, lightweight and hand-held triceps muscle exerciser has a base with a flat lower surface and a pair of arms extending upwardly therefrom and joined together to form a structure having an isosceles triangle shape. Grips are provided on each arm intermediate their ends. The arms extend from the base at an angle of about 35°.

20 Claims, 4 Drawing Sheets

TRICEPS PYRAMID EXERCISER

BACKGROUND OF THE INVENTION

1. Field Of The Invention

The present invention relates to a portable exercise device and, more particularly, to a portable exercise device used for strengthening the triceps muscle.

2. Description Of The Prior Art

The triceps is the great extensor muscle located on the back of the upper human arm and extending along the entire length of the rear of the humerus bone. The triceps is a three-headed muscle having origins in three separate and distinct places at or near the shoulder. However, all three muscle portions join together to form a common insertion tendon near the elbow.

There are many known methods and devices used today for exercising the triceps muscle. These include triceps extension exercises performed with dumbbells, barbells, cables or weight machines. However, these exercises require a trip to a gym or the purchase of special or expensive equipment. It is known to perform close-grip push-ups to exercise the triceps muscle. However, it is difficult to maintain the close grip needed to concentrate the exercise on the triceps muscle. In addition, as with the standard push-up, muscles other than the triceps, including the pectorals and deltoids, receive much more attention and concentration than the triceps.

A variety of portable devices have been developed for assisting a person in conducting standard or close-grip push-ups or other related exercises. See, for example, the devices shown in U.S. Pat. Nos. 2,666,640; 2,817,347; 3,115,338; 3,540,724; 4,232,863; 4,327,907; 4,351,525; 4,358,106; 4,854,573; Des. 216,529; Des. 267,420; Des. 269,691; and Des. 315,003. However, each of these devices primarily exercise the pectorals and front deltoid muscles, with little or no emphasis placed on the triceps muscle. In addition, many of these devices require two separate members to be used for conducting the exercise.

Therefore, it is an object of the present invention to provide a portable exercise device which concentrates the exercise effort primarily on the triceps muscle. It is an object of the invention to provide such a device which is easy to use, lightweight, and simple in construction. In addition, it is an object of the present invention to provide a triceps exercise device which is compact and can be used anywhere, which is durable and which is easy to manufacture. It is a further object to provide such a triceps exercise device which does not rely upon additional weights, but relies primarily upon the weight of the user in operation.

SUMMARY OF THE INVENTION

Therefore, I have developed an apparatus for exercising the triceps muscle of a human arm which includes a base having an upper surface and a substantially flat lower surface adapted to provide frictional engagement with a support surface in contact with the lower surface and to distribute pressures applied to the apparatus over a wide area. The apparatus also includes a first arm having a lower end attached to the upper surface of the base and extending upwardly from the upper surface at an angle thereto and terminating in an upper end spaced above the base. The apparatus also includes a second arm having a length substantially the same as the length of the first arm and having a lower end attached to the upper surface of the base at a location spaced from the attachment of the lower end of the first arm to the base and extending upwardly from the upper surface at an angle thereto toward the first arm and terminating in an upper end spaced above the base. The upper ends of the first and second arms are joined together to form an apex spaced above the base. The angle between the first arm and the base is substantially equal to the angle between the second arm and the base. The first arm and second arm are coplanar and are located in a plane which is substantially perpendicular to a plane including the lower surface of the base. Grip portions are formed on each of the first and second arms intermediate the upper ends and lower ends thereof.

It is preferred that the upper surface of the base be substantially flat and have beveled outer edges. The base can have a width where the arms are attached thereto approximately equal to the width of the arms and have a width which gradually flares into a substantially wider middle portion in the area beneath the apex. Preferably, the apex has a substantially flat upper surface.

The arms can be substantially rectangular in cross section and have front, bottom, back and top surfaces thereon. The grip portions can each include a plurality of recessed finger grooves extending at least partially about the arms, such as about the front and bottom surfaces of the arms. The angle between the arms and the base is between 25° and 50°, preferably about 35°.

The base and arms are preferably formed as a solid, one-piece structure, such as a structure injection molded from a plastic material. The plastic material can be an acrylonitrile-butadiene-styrene plastic or a blend of 10–20% polypropylene and the balance acrylonitrile-butadiene-styrene plastic material.

BRIEF DESCRIPTION OF THE PREFERRED EMBODIMENTS

Figure 1:
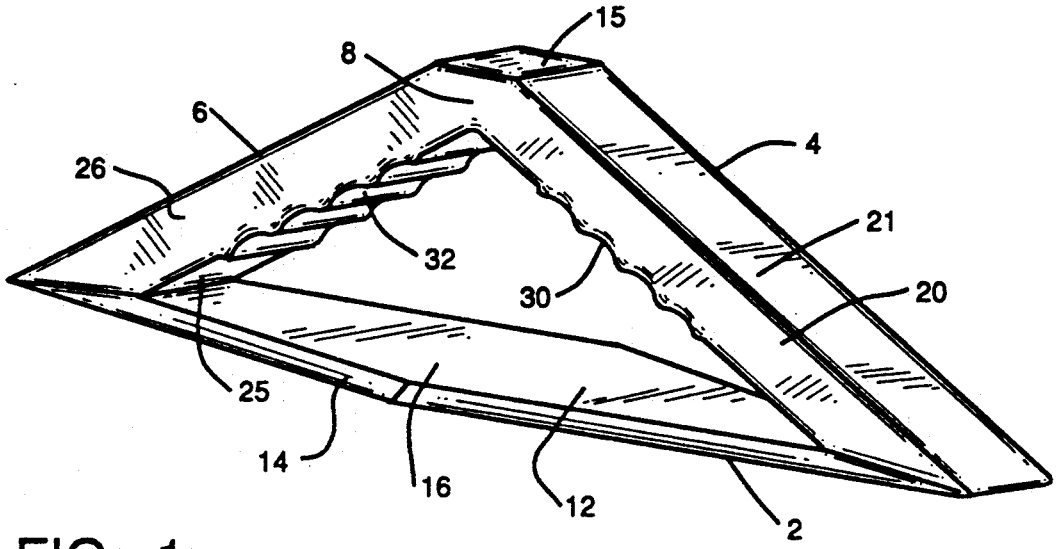
FIG. 1 is a perspective view of a triceps pyramid exerciser in accordance with the present invention.
Figure 2:
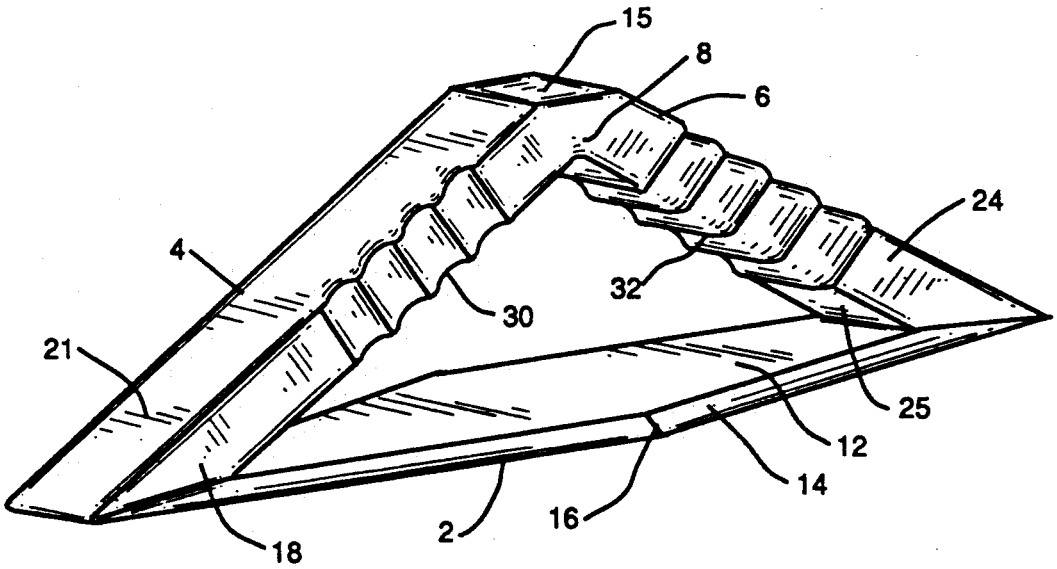
FIG. 2 is a perspective view, from another angle, of the triceps pyramid exerciser shown in FIG. 1.
Figure 3:
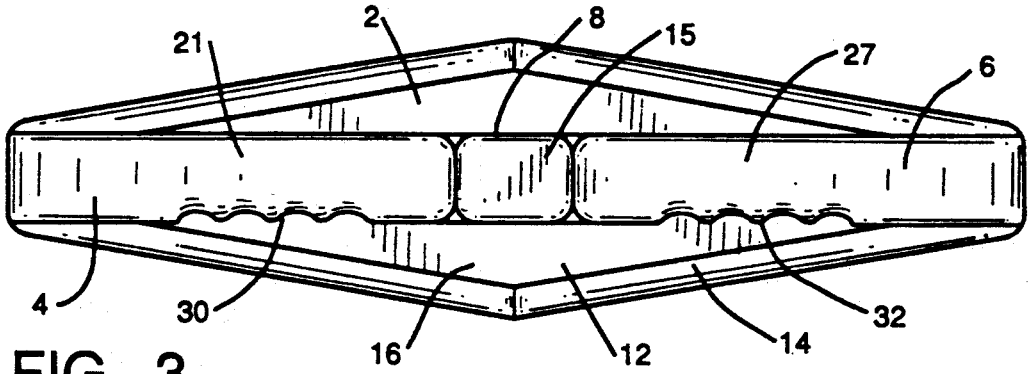
FIG. 3 is a top view of the triceps pyramid exerciser shown in FIG. 1.
Figure 4:
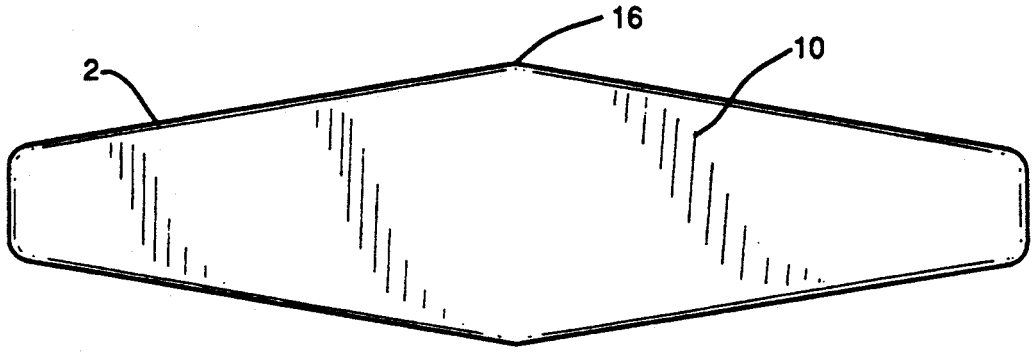
FIG. 4 is a bottom view of the triceps pyramid exerciser shown in FIG. 1.
Figure 5:
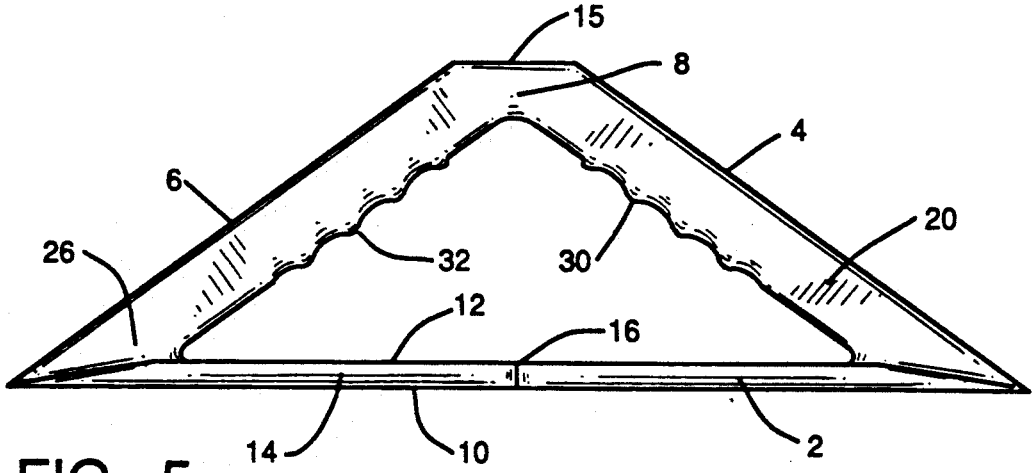
FIG. 5 is a back view of the triceps pyramid exerciser shown in FIG. 1.
Figure 6:
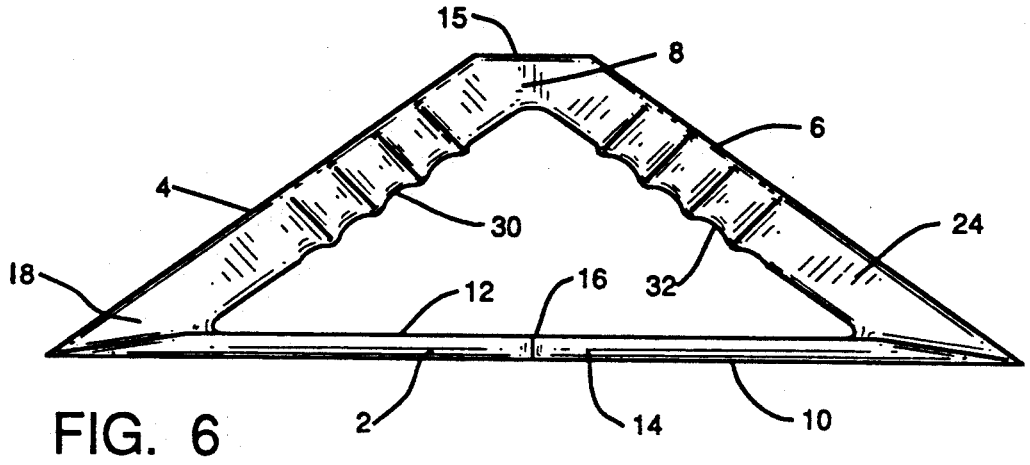
FIG. 6 is a front view of the triceps pyramid exerciser shown in FIG. 1.
Figure 7:
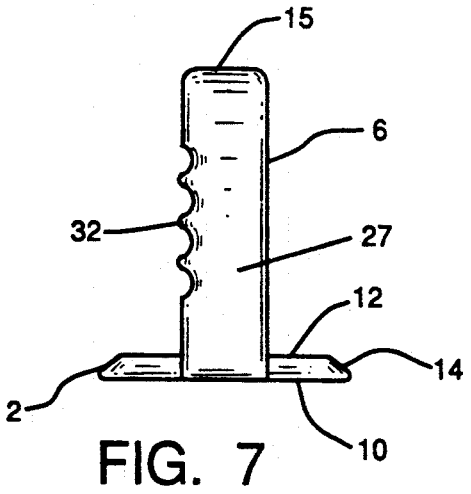
FIG. 7 is a right side view of the triceps pyramid exerciser shown in FIG. 1.
Figure 8:
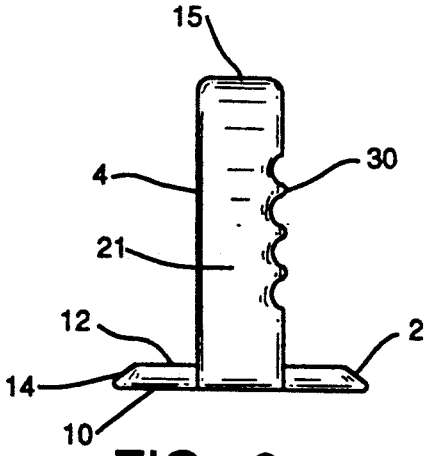
FIG. 8 is a left side view of the triceps pyramid exerciser shown in FIG. 1.

One embodiment of a triceps pyramid exerciser in accordance with the present invention is shown in FIGS. 1–8. The exerciser includes a substantially flat base 2 having a first arm 4 and a second arm 6 attached at their lower ends to the base 2 and attached to each other at their upper ends and forming an apex 8. The base 2 and the arms 4, 6 form a solid, one-piece, pyramid-like structure which has the approximate outer shape of an isosceles triangle, with the base 2 forming the base of the triangle and the arms 4 and 6 forming the equal length sides of the triangle.

The base 2 has a substantially flat lower surface 10 which provides frictional engagement with a support surface in contact with the lower surface 10 and distributes pressures applied to the exerciser over a wide area. The base 2 also has a substantially flat upper surface 12 with beveled outer edges 14. The lower end of the first arm 4 is attached to the upper surface 12 of the base 2 and the first arm 4 extends upwardly from the upper surface 12 at an angle thereto and terminates at its upper end which is spaced above the base 2. Similarly, the lower end of the second arm 6 is attached to the upper surface 12 of the base 2 at a location spaced from the attachment of the lower end of the first arm 4 to the base 2 and extends upwardly from the upper surface 12 at an angle thereto toward the first arm 4 and terminates at its upper end which is spaced above the base 2. The second arm 6 has a length which is substantially the same as the length of the first arm 4. The upper ends of the first arm 4 and second arm 6 are joined together at the apex 8 which is spaced above the base 2. Preferably, the apex 8 has a flat upper surface 15 where the arms 4, 6 meet. The first arm 4 and second arm 6 are coplanar and located in a plane which is substantially perpendicular to a plane including the lower surface 10 of the base 2.

In the embodiment shown in FIGS. 1–8, the base 2 does not extend beyond the attachment of the first arm 4 and second arm 6 thereto. The base 2 has a width where the arms 4, 6 are attached thereto approximately equal to the width of the arms 4, 6. The base 2 has flat sides which gradually and linearly flare outward from the area of the lower ends of the arms 4, 6 into a substantially wider middle portion 16 in the area beneath the apex 8. While the base 2 could be configured to be substantially larger and extend beyond the attachment of the arms 4, 6 thereto, the embodiment shown in FIGS. 1–8, in which the middle portion 16 of the base 2 is about three times the width of the arms 4, 6, is sufficient to provide the frictional engagement with a support surface upon which the exerciser would rest.

The angle between the first arm 4 and the base 2 is substantially equal to the angle between the second arm 6 and the base 2. The angle between each of the arms 4, 6 and the base 2 is between 25°–50°, preferably about 35° as shown. This angle provides for a comfortable angle for a user's hands while grasping the exerciser, yet provides a convenient overall size for the device. If the angle were too small, the base 2 would become too large. If the angle were too large, the arms 4, 6 would be too long and, hence, the apex 8 would be positioned too far above the base 2 for practical purposes.

While a variety of configurations for the arms 4, 6 can be used, the embodiment of the exerciser shown in FIGS. 1–8 includes rectangular cross sections for the first arm 4 and the second arm 6. In particular, the first arm 4 includes a front surface 18, bottom surface 19, back surface 20 and top surface 21. Similarly, the second arm 6 includes a front surface 24, bottom surface 25, back surface 26 and top surface 27. Grip portions are formed on the first arm 4 and second arm 6 intermediate their upper and lower ends. In the embodiment shown herein, the grip portions are formed of a plurality of recessed finger grooves extending at least partially about the arms 4, 6. Four recessed finger grooves 30 are provided on the first arm 4 and extend about the front surface 18 and bottom surface 19 thereof. The recessed finger grooves 30 on the first arm 4 also extend, to an extent, into the top side 21 thereof. Similarly, four recessed finger grooves 32 are provided on the second arm 6 and extend about the front surface 24 and bottom surface 25 thereof. The recessed finger grooves 32 of the second arm 6 extend, to an extent, into the top surface 27 thereof. The edges where the various arm surfaces meet are preferably rounded, particularly in the area of the grip portions.

It is preferred that the base 2, first arm 4 and second arm 6 be formed as a solid, one-piece structure. In a preferred embodiment, the exerciser is injection molded from a plastic material, such as acrylonitrile-butadiene-styrene, or a blend of 10–20% polypropylene and the balance acrylonitrile-butadiene-styrene. It is intended that the present invention be made in a small and lightweight, yet strong, structure which will permit a user to grasp the arms 4, 6 and conduct close-grip push-ups with the hands located close together, at a fixed location and at a comfortable angle. This arrangement concentrates the exercise effort on the triceps muscle of each arm of the user. In a prototype manufactured by applicant, the base 2 was provided in a length of 14", having a width at opposite ends of 1.125" and flaring into a width of 3.5" at its middle portion 16. The height of the upper surface 15 of the apex 8 above the lower surface 10 of the base 2 was approximately 4.5". The arms 4, 6 had front and back surfaces approximately 1" wide and had top and bottom surfaces approximately 1.125" wide. The base was approximately 0.38" thick. The angle of the arms 4, 6 to the base 2 was 35°.

Figure 9:
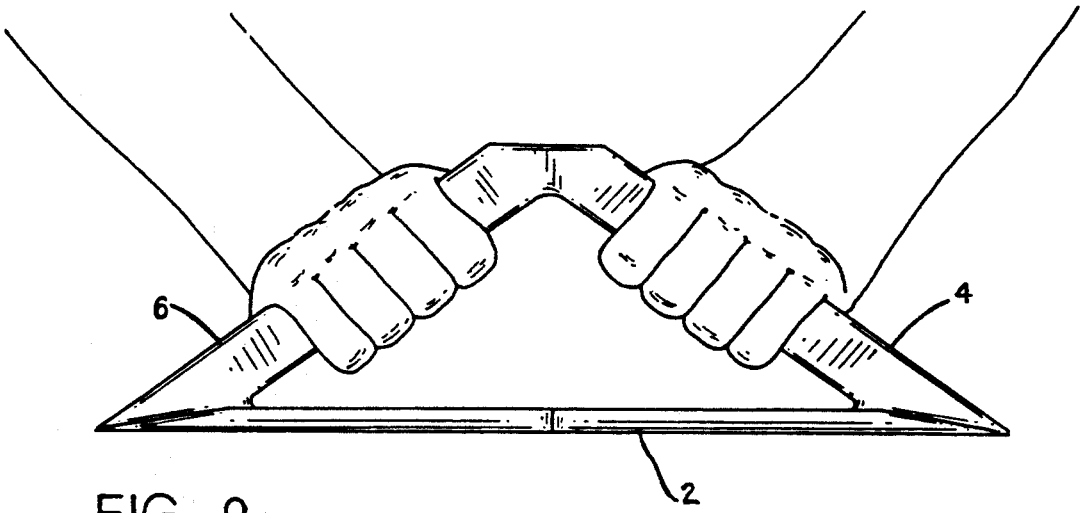
FIG. 9 is a front view of the triceps pyramid exerciser shown in FIG. 1 grasped by a person's hands.
Figure 10:
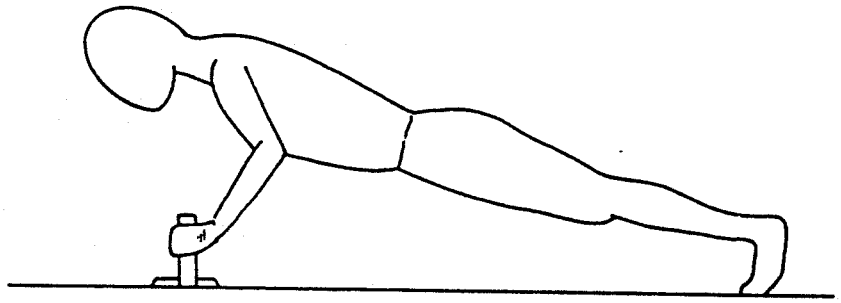
FIG. 10 is a side view of a person in a raised position using the triceps pyramid exerciser shown in FIG. 1.
Figure 11:
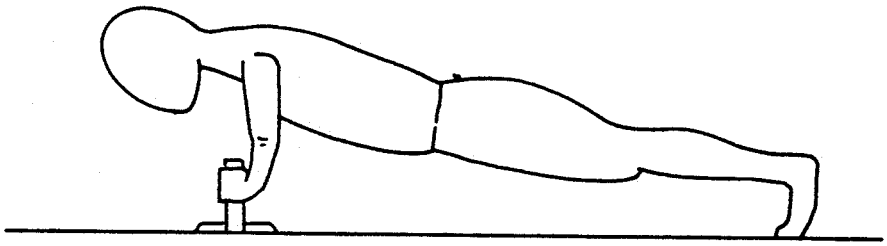
FIG. 11 is a side view, similar to FIG. 10, of a person in a lowered position using the triceps pyramid exerciser shown in FIG. 1.

The exerciser of the present invention can be used as shown in FIGS. 9–11. The exerciser is placed on a floor or other support surface with the arms 4, 6 approximately parallel to a user's shoulders. The front surfaces of the arms 4, 6 are positioned toward the user's head and the user's hands are grasped about the arms 4, 6 and in the recessed finger grooves 30, 32. This position is shown in FIG. 9. The user positions himself or herself above the exerciser as shown in FIG. 10, keeping the elbows as close to the body as comfortable. Then the user lowers his or her body toward the exerciser as shown in FIG. 11 and pushes off again to return the body to the position shown in FIG. 10. This exercise is then repeated as often as desired.

By providing the hands in a close-grip position and at a comfortable angle, the push-up motion carried out in the exercise isolates the triceps muscle to a substantial extent and exercises this muscle during the process described above. The rear deltoid muscle will also be exercised, but to a lesser extent. More importantly, this exerciser will not to any significant extent exercise the pectoral or front deltoid muscles, unlike a traditional push-up exercise. In sharp contrast, the triceps muscle is substantially isolated and exercised by the user's own body weight. The weight involved and the tension applied to the triceps muscle can be easily varied by shifting the user's body weight away from or toward the exerciser, or by contacting the user's knees to the ground rather than carrying out a full length toe/hand exercise as shown in FIGS. 10 and 11.

Since the present invention is a single piece exerciser, it is easy and convenient to use. The single piece construction provides for easy balance and control during operation and for superb stability in use. The base provides for a strong and secure support. The position of the wrists during the exercise is neutral, eliminating excess stress and strain, and offers comfortable hand grips for ease of movement while using the exerciser.

Having described above the presently preferred embodiments of the present invention, it is to be understood that the invention may be otherwise embodied within the scope of the appended claims.

I claim:

1. Apparatus for exercising the triceps muscle of a human arm, said apparatus comprising: a base having an upper surface and a substantially flat lower surface adapted to provide frictional engagement with a support surface in contact with said lower surface and to distribute pressures applied to said apparatus over a wide area; a first arm having a lower end attached to said upper surface of said base and extending upwardly from said upper surface at an angle thereto of about 35° and terminating in an upper end spaced above said base; a second arm having a length substantially the same as the length of said first arm and having a lower end attached to said upper surface of said base at a location spaced from the attachment of said lower end of said first arm to said base and extending upwardly from said upper surface at an angle thereto of about 35° and toward said first arm and terminating in an upper end spaced above said base; said upper ends of said first and second arms being joined together to from an apex spaced above said base and the angle between said first arm and said base being substantially equal to the angle between said second arm and said base, and said first arm and said second arm being coplanar and located in a plane which is substantially perpendicular to a plane including said lower surface of said base, with said base and said arms forming a pyramid structure having an outer shape of a triangle; and a grip means formed on said first arm and on said second arm intermediate said upper end and said lower end of each arm for providing a means for a user to securely and comfortably grasp said arms, with said apparatus usable by positioning said base on said support surface, positioning the user's hands about said grip means on said arms, and moving the user's body toward and away from said apparatus while concentrating the exercise effort in the user's triceps muscle.

2. The apparatus of claim 1 wherein the upper surface of said base is substantially flat.

3. The apparatus of claim 2 wherein the upper surface of said base has beveled outer edges.

4. The apparatus of claim 1 wherein said base has a width at the location where said arms are attached thereto approximately equal to the width of said arms and wherein said base gradually flares into a substantially wider middle portion in the area beneath said apex.

5. The apparatus of claim 1 wherein said apex has a substantially flat upper surface.

6. The apparatus of claim 1 wherein said arms are each substantially rectangular in cross section and have front, bottom, back and top surfaces thereon.

7. The apparatus of claim 6 wherein said grip means each include a plurality of recessed finger grooves extending at least partially about said arms.

8. The apparatus of claim 7 wherein said recessed finger grooves extend about said front and bottom surfaces of said arms.

9. The apparatus of claim 1 wherein said base and said arms are formed as a solid, one-piece structure.

10. The apparatus of claim 9 wherein said base and said arms are injection molded from a plastic material.

11. The apparatus of claim 10 wherein said plastic material is acrylonitrile-butadiene-styrene.

12. The apparatus of claim 10 wherein said plastic material is a blend of 10–20% polypropylene and the balance acrylonitrile-butadiene-styrene.

13. Apparatus for exercising the triceps muscle of a human arm, said apparatus comprising: a base having an upper surface and a substantially flat lower surface adapted to provide frictional engagement with a support surface in contact with said lower surface and to distribute pressures applied to said apparatus over a wide area; a first arm having a lower end attached to said upper surface of said base and extending upwardly from said upper surface at an angle thereto and terminating in an upper end spaced above said base; a second arm having a length substantially the same as the length of said first arm and having a lower end attached to said upper surface of said base at a location spaced from the attachment of said lower end of said first arm to said base and extending upwardly from said upper surface at an angle thereto toward said first arm and terminating in an upper end spaced above said base; said upper ends of said first and second arms being joined together to form an apex spaced above said base and the angle between said first arm and said base being substantially equal to the angle between said second arm and said base, and the angle between said first arm and said base being substantially equal to the angle between said second arm and said base, and the angle between each of said arms and said base being about 35°, and said first arm and said second arm being coplanar and located in a plane which is substantially perpendicular to a plane including said lower surface of said base, with said base and said arms formed as a solid, one-piece pyramid structure having an outer shape of a triangle; and a grip means formed on said first arm and on said second arm intermediate said upper end and said lower end of each arm for providing a means for a user to securely and comfortably grasp said arms, with said apparatus usable by positioning said base on said support surface, positioning the user's hands about said grip means on said arms, and moving the user's body toward and away from said apparatus while concentrating the exercise effort in the user's triceps muscle.

14. The apparatus of claim 13 wherein the upper surface of said base is substantially flat.

15. The apparatus of claim 13 wherein said base has a width at the location wherein said arms are attached thereto approximately equal to the width of said arms and wherein said base gradually flares into a substantially wider middle portion in the area beneath said apex.

16. The apparatus of claim 13 wherein said grip means each include a plurality of recessed finger grooves extending at least partially about said arms.

17. The apparatus of claim 13 wherein said base and said arms are injection molded from a plastic material.

18. Apparatus for exercising the triceps muscle of a human arm, said apparatus comprising: a base having an upper surface and a substantially flat lower surface adapted to provide frictional engagement with a support surface in contact with said lower surface and to distribute pressures applied to said apparatus over a wide area; a first arm having a lower end attached to said upper surface of said base and extending upwardly from said upper surface at an angle thereto and terminating in an upper end spaced above the base; a second arm having a length substantially the same as the length of said first arm and having a lower end attached to said upper surface of said base at a location spaced from the attachment of said lower end of said first arm to said base and extending upwardly from said upper surface at an angle thereto toward said first arm and terminating in an upper end spaced above the said base; said upper end of said first and second arms being joined together to form an apex spaced above said base and the angle between said first arm and said base being substantially equal to the angle between said second arm and said base, and the angle between each of said arms and said base being about 35°, and the arms each substantially rectangular in cross section and having front, bottom, back and top surfaces thereon, and said first arm and said second arm being coplanar and located in a plane which is substantially perpendicular to a plane including said lower surface of said base, with said base and said arms formed as a solid, one-piece pyramid structure having an outer shape of a triangle; and a grip means formed on said first arm and on said second arm intermediate said upper end and said lower end of each arm for providing a means for a user to securely and comfortably grasp said arms, with said grip means each including a plurality of recessed finger grooves extending at least partially about said arms, and with said apparatus usable by positioning said base on said support surface, positioning the user's hands about said grip means on said arms, and moving the user's body toward and away from said apparatus while concentrating the exercise effort in the user's triceps muscle.

19. The apparatus of claim 18 wherein said recessed finger grooves extend about said front and bottom surfaces of said arms.

20. The apparatus of claim 18 wherein said base has a width at the location where said arms are attached thereto approximately equal to the width of said arms and wherein said base gradually flares into a substantially wider middle portion in the area beneath said apex.

* * * * *